US006070759A

United States Patent [19]

Bridge et al.

[11] Patent Number: 6,070,759

[45] Date of Patent: Jun. 6, 2000

[54] CONTAINER WITH DISPENSING FEATURE IN OVERCAP

[75] Inventors: Michael J. Bridge, Glossop, United Kingdom; Calvin G. Hill, Hartsville, S.C.

[73] Assignee: Sonoco Development, Inc., Hartsville, S.C.

[21] Appl. No.: 09/151,788

[22] Filed: Sep. 11, 1998

[51] Int. Cl.[7] ..... B65H 3/60; G07F 11/00

[52] U.S. Cl. ..... 221/200; 221/288; 221/303

[58] Field of Search ..... 221/288, 303, 221/200, 280, 311; 206/268; 453/39

[56] References Cited

U.S. PATENT DOCUMENTS

| | | | |
|---|---|---|---|
| 423,276 | 3/1890 | Rech, Jr. | 453/39 |
| 1,935,905 | 11/1933 | Gresenz . | |
| 1,984,228 | 12/1934 | Morhous . | |
| 2,480,733 | 8/1949 | Hermani . | |
| 3,540,617 | 11/1970 | Iorio . | |
| 3,604,593 | 9/1971 | Curci | 221/288 |
| 3,967,819 | 7/1976 | Lewis . | |
| 4,154,365 | 5/1979 | Lorca . | |
| 4,253,842 | 3/1981 | Ehrlich | 221/309 X |
| 4,681,240 | 7/1987 | Wyant . | |
| 4,844,295 | 7/1989 | Deardorff | 221/288 X |
| 4,871,093 | 10/1989 | Burshtain et al. . | |
| 4,893,728 | 1/1990 | Jennings . | |
| 4,949,865 | 8/1990 | Turner | 220/90.4 |
| 4,955,500 | 9/1990 | Rhoads . | |
| 5,020,719 | 6/1991 | Roth et al. . | |
| 5,062,539 | 11/1991 | Chandler . | |
| 5,071,663 | 12/1991 | Dugan | 426/112 X |
| 5,150,803 | 9/1992 | Cartellone . | |
| 5,219,085 | 6/1993 | Craft et al. . | |
| 5,320,215 | 6/1994 | Brennan . | |
| 5,370,220 | 12/1994 | Wang . | |
| 5,423,451 | 6/1995 | Snyder . | |
| 5,603,404 | 2/1997 | Nazare et al. . | |
| 5,779,095 | 7/1998 | Diamond . | |

FOREIGN PATENT DOCUMENTS

| | | |
|---|---|---|
| 418475 | 10/1934 | United Kingdom . |
| 2 321 239 | 7/1998 | United Kingdom . |

*Primary Examiner*—Christopher P. Ellis
*Assistant Examiner*—Gene O. Crawford
*Attorney, Agent, or Firm*—Bullwinkel Partners, Ltd.

[57] ABSTRACT

A container having a single unit dispensing feature built into the container cap is provided. The dispensing feature is an opening of sufficient dimensions to allow the controlled release of product. An optional incline located in the cap guides product toward the opening. The product is dispensed by inverting and tilting the container.

1 Claim, 2 Drawing Sheets

CONTAINER WITH DISPENSING FEATURE IN OVERCAP

BACKGROUND

1. Field of the Invention

This patent relates to a package having a unique dispensing feature allowing a consumer to remove product in single increments.

2. Description of the Related Art

Many products such as medications, bandages, dry mixes, snack foods and tea bags are used in single unit quantities but packaged in multiple unit containers. Few packages exist that conveniently release a single unit at a time.

Hermani U.S. Pat. No. 2,480,733 describes a powder dispensing container having an opening in a dispensing top and a slide which may be moved back and forth for opening and closing the slot. However, the Hermani device is a powder dispensing container and is not designed for dispensing discrete product units.

Other packages having dispensing slots are disclosed in the prior art. For example, Gresenz U.S. Pat. No. 1,935,905 describes a package for interfolded sheets of tissue paper having a slot which terminates at one end short of the end wall, thus preventing the withdrawal of a second sheet as incident to the withdrawal of a first sheet. Lorca U.S. Pat. No. 4,154,365 describes a container for dispensing small articles such as pills and capsules. The container comprises two spring loaded receptacles, one within the other, so that when the two receptacles are pressed together, openings in each receptacle become aligned, thus allowing the dispensing of the container contents.

Wyant U.S. Pat. No. 4,681,240 describes a package for dispensing towels having a dispensing slit through which the towels are dispensed one at a time. A layer of adhesive adjacent the slit holds the next towel in its partly withdrawn place until it is ready for use. Burshtain et al. U.S. Pat. No. 4,871,093 describes a flexible bodied container for dispensing candy, pills and the like through a side slit. The slit is formed in an elastically resilient material attached to the inner surface of the container and is initially covered by a removable panel. During use, the container contents may be dispensed by squeezing the container sides which causes the slit edges to move apart. The slit automatically recloses after each use. Finally, Wang U.S. Pat. No. 5,370,220 describes a container for displaying and dispensing articles held in vertical troughs. The container has a scored strip 15 that when removed exposes a slot 12 through which the articles may be removed one at a time.

With the exception of Hermani, none of these references disclose a dispensing feature located in the container overcap. Furthermore, none discloses a container that can be inverted to remove a product unit.

Thus it is an object of the present invention to provide a container that allows for the controlled release of product.

A further object of the present invention is to provide a container which conveniently dispenses single product units.

A still further object of the present invention is to provide a container wherein the dispensing feature is located in the overcap, thus requiring the container to be turned over to dispense product.

Yet another object of the present invention is to provide a container that allows the controlled release of product while maintaining retail shelf space appeal.

Still another object of the present invention is to provide a single product unit dispenser that is easy and convenient to use.

Further and additional objects will appear from the description, accompanying drawings, and appended claims.

SUMMARY OF THE INVENTION

The present invention is a device for controlled dispensing of product from a container. More specifically, the present invention relates to a container having a single unit dispensing feature built into the container cap. The dispensing feature comprises an opening of sufficient dimensions to allow the controlled release of product. An optional incline located in the cap guides product toward the opening.

THE DRAWINGS

DETAILED DESCRIPTION OF THE INVENTION

Figure 3:
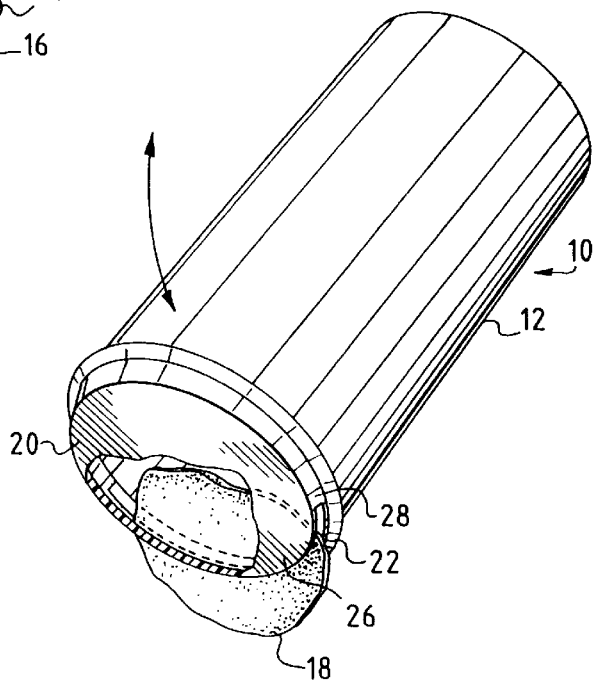
FIG. 3 is a perspective view of the container of FIG. 1 shown inverted with a single product unit being dispensed.

Turning to the drawings, there is shown in FIGS. 1–4 one embodiment of the present invention, a container 10 having a cylindrical body 12 and an overcap 14 having a built-in dispensing feature. The dispensing feature is an opening 16 of sufficient size and dimensions to allow the dispensing of a single product unit. Items 18 may be stacked in the container 10 and are dispensed by turning the container 10 upside down and removing the items 18 through the slit 16. FIG. 3 shows a single item 18 being dispensed through the slit 16 in an inverted container 10.

Figure 2:
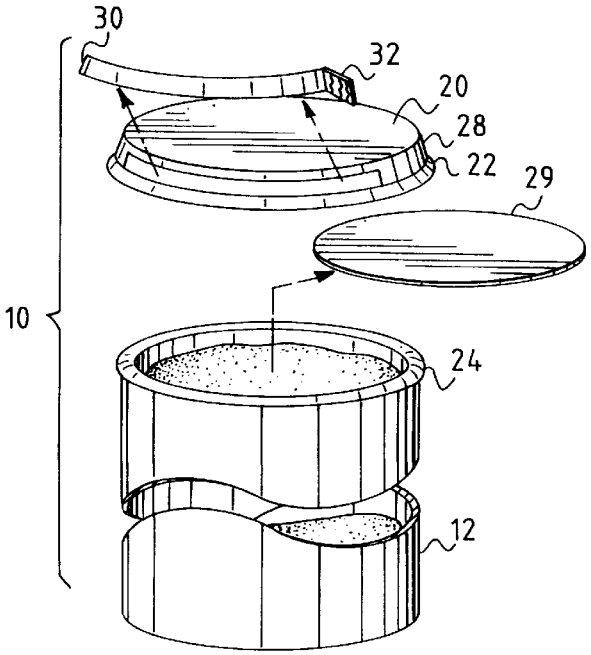
FIG. 2 is an exploded view of the container of FIG. 1.
Figure 4:
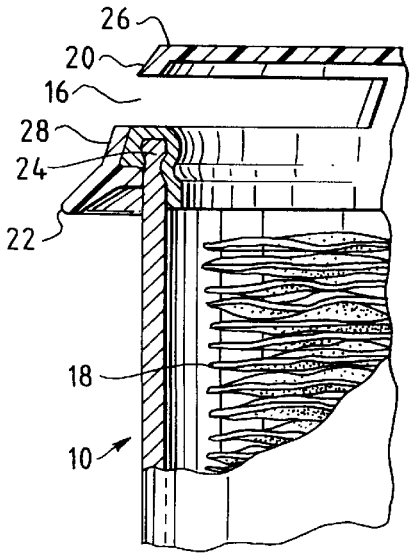
FIG. 4 is a partial cutaway view of a portion of the container of FIG. 1.

In the preferred embodiment, the overcap 16 comprises a cylindrical portion 20 and a lip 22 disposed circumferentially around the base of the cylindrical portion 20. Where the container body 12 has a beaded top 24, as best shown in FIGS. 2 and 4, the lip 22 should be configured to fit snugly over the bead 24.

The cylindrical portion 20 has a planar top surface 26 and a sidewall 28 circumferentially disposed about the planar top surface 26 and extending axially downward. The slit 16 is located in the overcap sidewall 28. A removable membrane 29 or other type of closure may be used to seal the container 10 before the first use. The membrane preferably is located under the overcap as shown in FIG. 2. Alternatively, a plastic seal (not shown) may be placed over the overcap 14 and at least a portion of the container body 12 to maintain product freshness before the first use.

Although the figures depict a cylindrical container having a round cross section, other container shapes are anticipated, such as a cylinder having a rectangular cross section. A tubular shaped container body, that is, a body shaped like a narrow channel, is preferred, since the container 10 must be inverted to dispense product 18 and since a narrow channel is best suited for stacking product units 18. When the container 10 is inverted, gravity causes the product units 18 to descend in the direction of the cap 14, where tilting causes a single product unit 18 to be dispensed through the opening 16.

Figure 1:
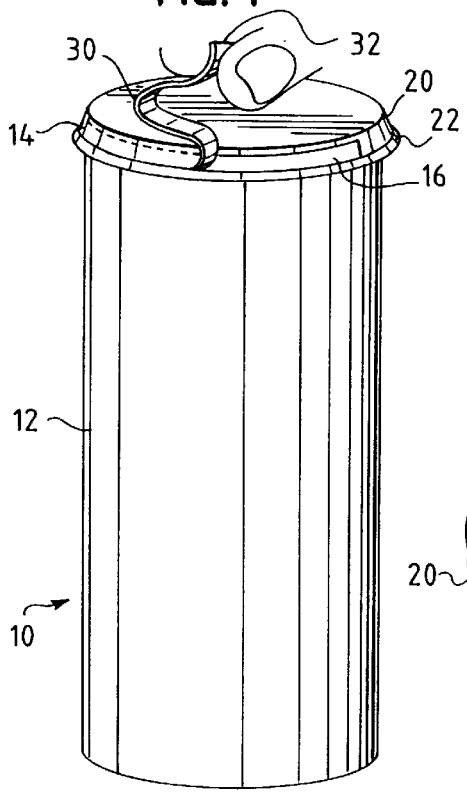
FIG. 1 is a perspective view of one embodiment of a container with a dispensing feature in the overcap.

In the embodiment shown in FIGS. 1–4, the opening 16 in the container overcap is created by removing a strip 30 of the overcap sidewall 28 by pulling on a tab 32 (see FIG. 1). The strip 30 may be perforated or scored around its edges to facilitate removal. The strip may be discarded after removal. Alternatively, in between uses, the strip 30 may be repositioned over the opening 16 to maintain the freshness of the unused product inside the container. Where the strip 30 is used to recover the hole it is advantageous for the strip to be permanently attached to the overcap sidewall 28 via a living hinge at the end of the strip opposite the tab 32.

In another embodiment, the opening 16 in the container overcap 14 is created by removing a strip of reusable tape (not shown) that covers the opening. In between uses, the opening 16 may be recovered with the reusable tape. In still another embodiment, the opening is created by removing a removable plug (not shown) from the opening 16. In between uses, the plug may be repositioned within the opening. Other means for creating and resealing the opening 16 are anticipated, such as using sliding or pivoting panels.

Figure 5:
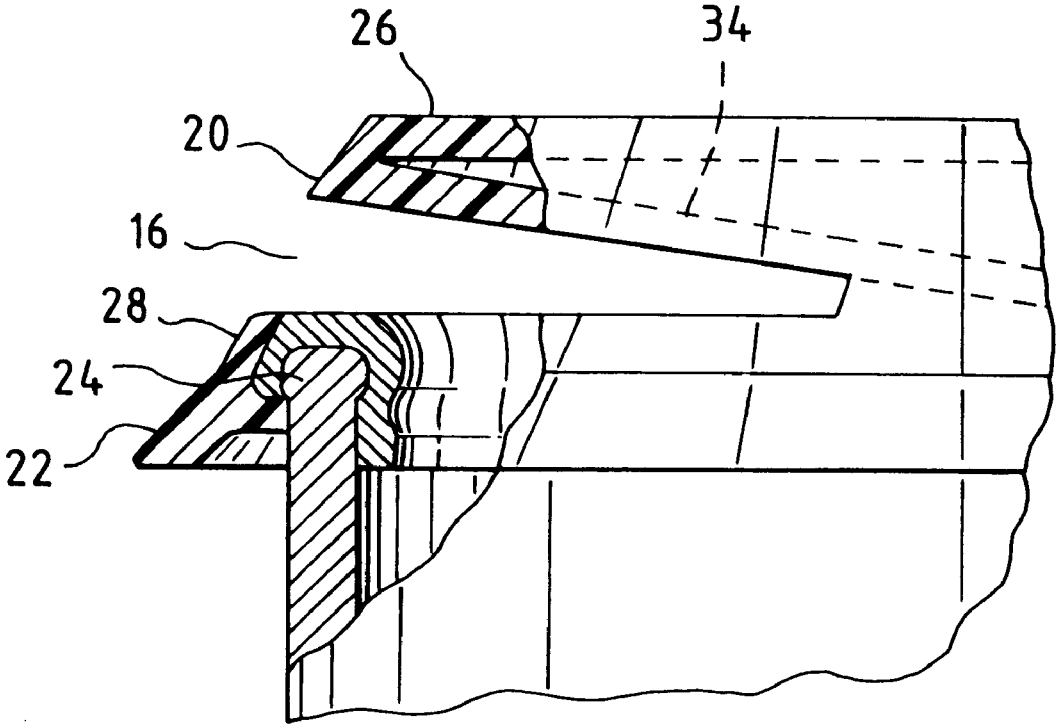
FIG. 5 is a partial cutaway view of a portion of the container of FIG. 1 with the addition of an incline located inside the container cap.

In some applications, such as tea bags, it may be advantageous to provide a ramp or incline 34 (FIG. 5) located inside the overcap 14 to guide the product into the opening 16. The incline 34 may be formed integrally with the overcap or formed separately and placed in the overcap during manufacture.

Other modifications and alternative embodiments of the invention are contemplated which do not depart from the spirit and scope of the invention as defined by the foregoing teachings and appended claims. It is intended that the claims cover all such modifications that fall within their scope.

We claim as our invention:

1. A container for dispensing substantially flat product units stacked in an orderly fashion within the container, said container comprising:

a tubular body shaped like a narrow channel for holding the product units in a stacked orderly fashion, the tubular body having a closed bottom end and an open top end;

a single overcap attached directly to the open top end of the tubular body in a fixed non-rotatable position, said overcap having a horizontal planar top, a vertical sidewall circumferentially disposed about the planar top and extending downward to a base, and a slot communicating directly with the inside of the tubular body and circumferentially disposed in the sidewall and configured to dispense single product units; and an incline located in the overcap facing the slot with a downward slope to guide product toward the slot when the container is inverted.

* * * * *